United States Patent [19]

Bromley

[11] 4,249,735

[45] Feb. 10, 1981

[54] ELECTRONIC SIMULATED FOOTBALL GAME AND METHOD

[76] Inventor: Eric Bromley, West Simsbury, Conn.

[21] Appl. No.: 919,860

[22] Filed: Jun. 28, 1978

[51] Int. Cl.[3] ..... A63F 9/00

[52] U.S. Cl. ..... 273/94; 273/85 G

[58] Field of Search ..... 273/1 E, 85 G, 88, 94, 273/DIG. 28, 237, 310–313; 364/410; 340/323 R

[56] References Cited

U.S. PATENT DOCUMENTS

| | | |
|---|---|---|
| Re. 28,507 | 8/1975 | Rusch . |
| D. 220,503 | 4/1971 | Church . |
| 1,518,754 | 12/1924 | Prina et al. |
| 1,616,280 | 2/1927 | Prins . |
| 1,648,956 | 11/1927 | Meade . |
| 2,148,354 | 2/1939 | Hurlock . |
| 2,356,057 | 8/1944 | Householder . |
| 2,551,806 | 5/1951 | McKeener . |
| 2,616,696 | 11/1952 | Field . |
| 2,687,889 | 8/1954 | Wiltshire . |
| 2,713,489 | 7/1955 | Glaser . |
| 2,877,019 | 3/1959 | Keister . |
| 2,933,316 | 4/1960 | Mancini . |
| 3,123,360 | 3/1964 | Peckham . |
| 3,214,172 | 10/1965 | Williams . |
| 3,231,276 | 1/1968 | Cooper . |
| 3,315,962 | 4/1967 | Budai . |
| 3,418,729 | 12/1968 | Ravick . |
| 3,419,271 | 12/1968 | Waskowsky . |
| 3,533,629 | 10/1970 | Raven . |
| 3,572,711 | 3/1971 | Conklin . |
| 3,587,100 | 6/1971 | Doremus . |
| 3,604,707 | 9/1971 | Hurley . |
| 3,654,392 | 4/1972 | Beinhocker et al. |
| 3,672,674 | 6/1972 | Reed . |
| 3,728,480 | 4/1973 | Baer . |
| 3,729,193 | 4/1973 | Labis . |
| 3,731,986 | 5/1973 | Fergason . |
| 3,744,795 | 7/1973 | Lipscomb . |
| 3,751,825 | 8/1973 | Barrett . |
| 3,770,271 | 11/1973 | Kim . |
| 3,772,874 | 11/1973 | Lefkowitz . |
| 3,777,410 | 12/1973 | Robinson . |
| 3,778,058 | 12/1973 | Rausch . |
| 3,790,169 | 2/1974 | Brown . |
| 3,796,433 | 3/1974 | Fraley et al. |
| 3,801,100 | 4/1974 | Lebrun . |
| 3,809,395 | 5/1974 | Allison, Jr. et al. |
| 3,868,112 | 2/1975 | Avera . |
| 3,888,491 | 6/1975 | Bernard et al. ..... 273/237 |
| 3,894,346 | 7/1975 | Ward et al. |
| 3,895,798 | 7/1975 | Collins . |
| 3,895,799 | 7/1975 | Rinne . |
| 3,895,807 | 7/1975 | Friedman . |
| 3,921,161 | 11/1975 | Baer . |
| 3,929,338 | 12/1975 | Busch . |
| 4,006,474 | 2/1977 | Lukkarila . |
| 4,016,362 | 4/1977 | Bristow et al. |
| 4,017,072 | 4/1977 | Kurtz . |
| 4,017,075 | 4/1977 | Wilson ..... 273/94 |
| 4,034,983 | 7/1977 | Dash et al. |
| 4,043,406 | 8/1977 | Wolfe . |
| 4,045,789 | 8/1977 | Bristow . |
| 4,093,221 | 6/1978 | Dash . |
| 4,121,284 | 10/1978 | Hyatt . |
| 4,148,485 | 4/1979 | Rains . |
| 4,112,422 | 9/1978 | Mayer et al. |
| 4,114,882 | 9/1978 | Mau . |
| 4,177,462 | 12/1979 | Chung . |

FOREIGN PATENT DOCUMENTS

| | | |
|---|---|---|
| 920164 | 1/1973 | Canada . |
| 2408027 | 5/1975 | Fed. Rep. of Germany . |
| 2617147 | 10/1977 | Fed. Rep. of Germany . |
| 2807231 | 8/1978 | Fed. Rep. of Germany . |

| | | |
|---|---|---|
| 2826731 | 12/1978 | Fed. Rep. of Germany . |
| 50-52871 | 1/1975 | Japan . |
| 50-116618 | 6/1975 | Japan . |
| 50-71143 | 9/1975 | Japan . |
| 50-47372 | 11/1975 | Japan . |
| 51-72044 | 1/1976 | Japan . |
| 51-119828 | 9/1976 | Japan . |

OTHER PUBLICATIONS

*Electronic Design*; "Nonvideo Games Pit Man vs. Microprocessor"; May 10, 1977, p. 21.

*Mattel Electronics TM Football Game Instructions*; 1977.

Bless, G.; "Electronic Table Top Football"; *Funkschad*; Jul. 1975; pp. 91–94.

*Primary Examiner*—Vance Y. Hum

[57] ABSTRACT

An electronic simulated football game includes handholdable housing with provision for displaying and moving a multiplicity of offensive play symbols in response to commands entered from a keyboard to an operational circuit that controls the display. The provision of more than one offensive play symbol affords the possibility of simulating blocking and passing, provisions for which are made in the operational circuit. The operational circuit controls the display to provide and move an offensive play symbol representing a football during passing and kicking plays. Finally, status information, such as the score and the down number, is displayed on the same part of the display panel as that on which play action is shown.

57 Claims, 13 Drawing Figures

ELECTRONIC SIMULATED FOOTBALL GAME AND METHOD

BACKGROUND OF THE INVENTION

The present invention relates to the general field of electronic games, particularly the type of electronic game that simulates a field game such as football.

Indoor games for simulating field games such as football by manipulating tokens that simulate the players of such field games have long been known to the art. More recently, electronic games that move player symbols electronically have appeared on the scene, the most relevant to the present discussion being the electronic football game. In this type of game a display panel is provided, and the operator gives commands to cause movement of a symbol for an offensive play symbol. Simultaneously, the electronic device itself determines movements for the defensive players, normally in a pseudorandom manner so that the operator is not able to anticipate the moves of the defender symbols. In this type of game, the state of the art includes a game that provides for an offensive play symbols and a multiplicity of defensive-player symbols. According to one refinement, the operator can enter a command to simulate a kick, and a field goal is indicated if the simulated offensive player is within a predetermined simulated distance from the simulated goal line.

Though such an arrangement simulates some aspects of a real football game, a measure of verisimilitude is missing because of the absence of, among other things, the simulation of blocking and passing. It is among the advantages of the present invention that it permits simulation of passing and blocking, thus affording a degree of realism greater than that found in the prior-art devices.

SUMMARY OF THE INVENTION

According to the present invention, a hand-holdable housing with a display panel on its upper surface that includes a visual simulation of a playing field of the type on which a ball-type game is played and is adapted to display symbols in response to signals applied to it. An operational-circuit means is operatively connected to the display panel to generate and transmit electrical signals to the display panel that produce offensive play symbols and defensive-player symbols on the simulated playing field. One of the offensive play symbols at a time simulates the position of the ball. The operational-circuit means include means for moving a multiplicity of the offensive play symbols in a controlled manner and means for moving the defensive-player symbols in a variable manner. It also includes means for detecting the independent coincidence of a multiplicity of offensive play symbols with a multiplicity of defensive-player symbols and for terminating play action upon the detection of a coincidence between a ball-position symbol and a defender symbol, and it prohibits the movement of a defensive player symbol coincident with an offensive play symbol other than the ball-position symbol towards the ball-position symbol to simulate blocking of the defensive-player symbol. The operational-circuit means further includes means for monitoring play action to record status information and for producing signals to indicate the status information. The status-information signals are transmitted to the display panel to display the status information on the display panel.

A control board that includes a multiplicity of manually operable control elements is connected to the operational-circuit means for transmission of signals to the circuit through operation of the control elements. The offensive-movement means is arranged to produce manually controlled movement of at least one of the offensive players according to signals transmitted from the control board.

According to the preferred embodiment, the coincidence-detection means suppresses the display of a defensive-player symbol when the monitoring means detects coincidence between that defensive-player symbol and an offensive play symbol other than the ball-position symbol. The suppression lasts until the end of play action, thereby simulating a defensive player being taken out of the play by a blocker. Preferably, the coincident offensive-play symbol is also suppressed until the end of play action. The operational-circuit means may move the ball-position symbol in a path to simulate a pass, and means may be provided for detecting coincidence between the ball and an offensive play symbol simulating a receiver. Thus, a simulated pass completion is detected. The coincident receiver symbol would be replaced by the ball-position symbol between coincidence and termination of play action.

Preferably, the means for detecting coincidence between the ball-position and at least one of the defensive-player symbols indicates an interception when the coincidence occurs during a pass simulation. It is also preferred for the ball-position symbol to differ from the other offensive play symbols so that a pass completion can be indicated by the replacement of the coincident receiver symbol with the ball-position symbol.

Another feature exemplified by the preferred embodiment on pass plays is the maintenance of separation between a defensive-player symbol and a receiver symbol.

Among the other features of the preferred embodiment is the use of the simulated playing-field area of the display panel as the indicator means. The signals produced by the monitoring means include signals for producing symbols on the simulated playing field that indicate status information such as the score of the simulated football game, the field position, the number of the down, the number of yards remaining before a first down, and the time remaining in the simulated game.

Further realism is afforded by the operational-circuit means generating and transmitting signals to the display panel to produce symbols simulating players whose orientations with respect to each other at the beginning of play action is dependent upon signals transmitted from the control board. In addition, the defensive-movement means moves each of the defensive-player symbols according to moves selected from a repertoire of possible moves, and the defensive-player symbols are divided into groups that have different repertoires of possible moves. At least one of the groups has a repertoire that depends on the position on the display panel of at least one of the offensive play symbols. Also realistic is the recording by the monitoring means of simulated yardage gain or loss as part of the status information. On pass plays the defensive-movement means moves some of the defensive-player symbols in a variable manner toward the receiver symbols.

In order to provide more than one skill level, the operational-circuit means generates and transmits signals to the display panel to produce a number of defensive-player symbols at the beginning of play action that depends on signals from the control board, and the defensive-movement means moves the defensive-player symbols at a rate that depends on signals transmitted from the control board. The defensive-movement means also moves the defensive-player symbols at a rate that is dependent on the position on the display of at least one of the offensive play symbols in order to enhance the realism of the simulated game.

A method of simulating a team game is taught that includes providing a simulated playing field and producing offensive play and defensive-player symbols on it, one of the offensive play symbols at a time simulating the position of the ball. The method further includes providing means for moving a multiplicity of the offensive play symbols under manual control, moving at least a selected one of the offensive play symbols by manipulation of the manual control means, moving at least some of the defensive-player symbols in a variable manner, detecting the independent coincidence of a multiplicity of offensive play symbols with a multiplicity of defensive-player symbols, and terminating play action upon detection of a coincidence between the ball-position symbol and a defensive-player symbol. Also included are the steps of monitoring play action to record information concerning the status of the simulated game displaying the status information.

Preferably, the method includes the steps of moving the ball symbol in a path to simulate a pass, detecting coincidence between the ball symbol and an offensive play symbol simulating a receiver and thereby detecting a simulated pass completion, and replacing a coincident receiver symbol with the ball-position symbol between coincidence and termination of play action.

BRIEF DESCRIPTION OF THE DRAWINGS

These and further features and advantages of the present invention can be appreciated by reference to the attached drawings, in which.

DETAILED DESCRIPTION OF THE PREFERRED EMBODIMENT

Figure 1:
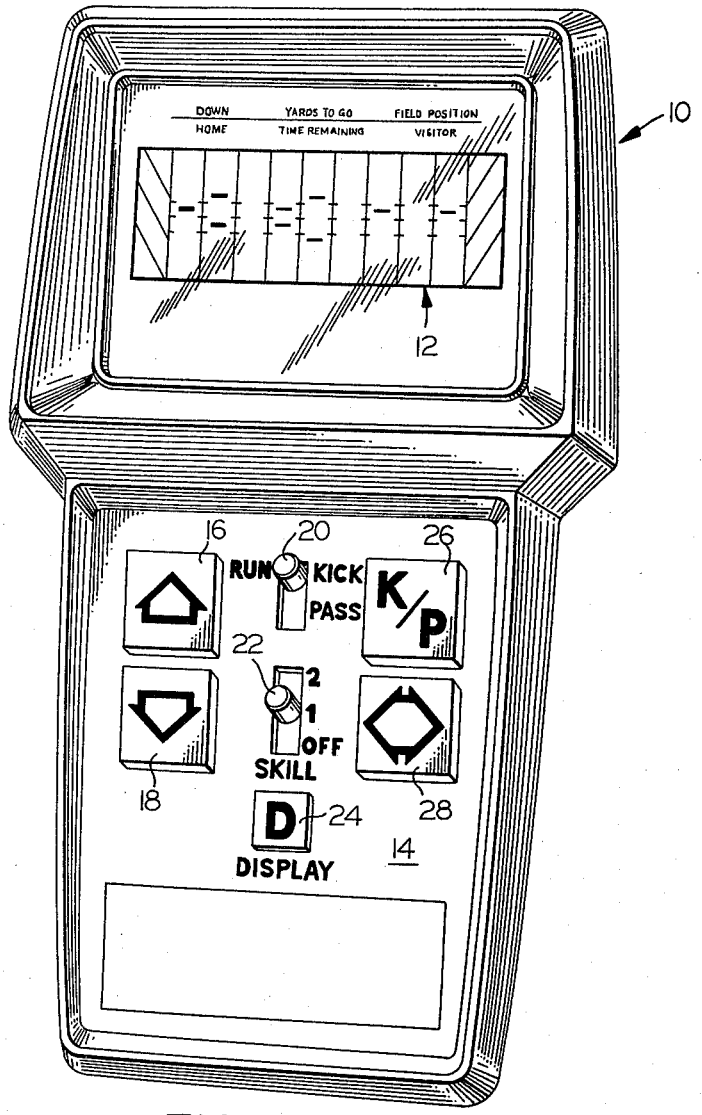
FIG. 1 is a perspective view of the apparatus of the preferred embodiment.

The preferred embodiment of an apparatus for an electronic football game using a multiplicity of offensive play symbols is illustrated in FIG. 1. It consists of a housing 10 having the general size and shape of a hand-held calculator. A display panel 12 is mounted in one end of the housing, and a control board 14 occupies the other end of the housing. The display panel includes a matrix of light-emitting diodes. Lines that simulate yard lines on a football field are scribed on the display panel. During play, the apparatus itself displays a multiplicity of relatively dim symbols representing moving defensive players in a variable manner, that is, in a manner that appears unpredictable to the operator, by successively lighting adjacent segments of the LED display. Offensive players are symbolized by brighter LEDs, and the symbol for the offensive player denominated the ball carrier flashes on and off. Unlike the defensive player symbols, the offensive play symbols are moved in a controlled manner, being directed by the operator from the control board. A switch 20 in the upper central portion of the control board 14 is operated to indicate whether the operator intends to pass, on the one hand, or run or kick on the other. Should he indicate a running play, he can move the ball carrier up or down with the up button 16, which is labeled with an arrow pointing up, or the down button 18, which is labeled with an arrow pointing down. He can also move the ball carrier downfield by operating the downfield button 28, which is labeled with a double-headed horizontal arrow. Pressing the downfield button 28 causes the ball carrier to move left or right, depending on which side has the ball. In the typical game, two people would be playing, the person whose team is on offense being the one operating the controls.

There being a multiplicity of offensive players, operation of directional buttons 16, 18, or 28 during a running play will cause all of the offensive players to move in tandem; that is, the offensive players maintain their positions with respect to each other as they move along the field. This is in contrast to a pass play (indicated by the pass run/switch 20), in which the directional keys 16, 18, and 28 move only the offensive player denominated the receiver while the ball carrier and the remaining offensive players remain stationary. The ball carrier can be moved during a pass play only upon completion, when the erstwhile receiver becomes the ball carrier.

The remaining manually operable control elements on the control board 14 are a three-position switch 22 located in the center of the control board 14, a key located below it and labeled with a D, and a key 26 whose label reads "K/P." The three-position switch 22 is provided for turning on the unit and indicating which level of skill is desired. The choice of a skill level determines the initial number of defenders and also has other effects detailed below. The "D" key 24 resets the unit after a play and causes status information such as the score and the time remaining to appear on the display panel. Execution of a pass or a kick, depending on the position of switch 20, is effected by operation of the "K/P" key 26.

Not shown in FIG. 1 are openings on the reverse side of the housing 10 provided for transmission of sound waves from a sound-generating device located inside the unit. The sound-generating device provides various sounds for purposes such as indicating the occurrence of a tackle, a turnover, or a score.

The operation of the unit is controlled by a microprocessor chip, shown in FIG. 12A, that has been programmed to carry out the functions detailed below and suggested by the diagram of FIG. 2. Instructions can be entered from the control board, indicated by block 46. An operational circuit, indicated by dashed lines 32, receives signals from the control board 46 and processes them to display action on the display panel 30. The operational circuit 32, which includes the microprocessor, also controls the sound-generating device, indicated by reference numeral 48.

Figure 5:
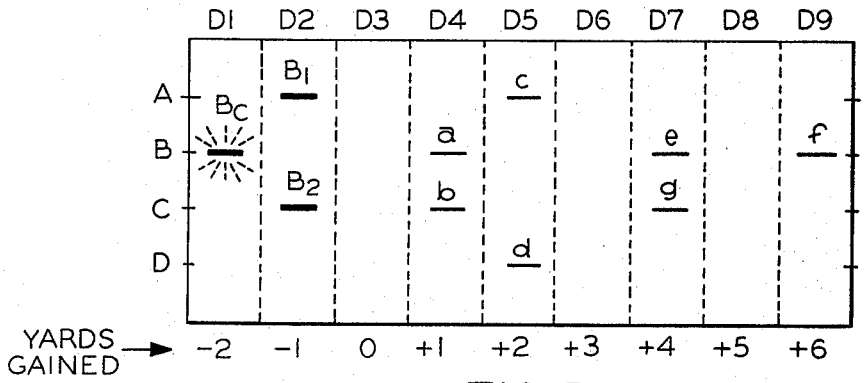

The operational-circuit means is programmed to generate and transmit signals to the display panel 30 to produce offensive play and defensive-player symbols on the simulated playing field. Specifically, offensive players are simulated by brightly illuminated LED segments such as those indicated in FIG. 5 by the references $B_c$, $B_1$, and $B_2$. Player $B_c$ is distinguished by blinking on and off, and this indicates that $B_c$ is the ball carrier. The operational-circuit means also generates signals for placing symbols for defensive players on the display panel. The defensive players are indicated in Figures by the references a, b, c, d, e, f, and g. By appropriate programming, the operational-circuit means is made to include an offensive-player-motion means, indicated by box 34 of FIG. 2, that moves the offensive players according to directions from the control panel 46. When the run/pass switch 20 (FIG. 1) is operated to the "RUN" position, all of the players are positioned at the beginning of play as indicated in FIG. 5. Defensive player g may or may not be present, depending upon the position of the three-position switch 22; defensive player g is only provided when switch 22 is in position 2, not position 1.

All players remain in their FIG. 5 positions until one of the directional buttons 16, 18, and 28 is pressed. Each operation of one of these directional buttons causes all three offensive players to move one position in the direction indicated by the operated button. Operation of the up button 16 or down button 18 can cause one of the blockers $B_1$ or $B_2$ to be moved off the display, but the ball carrier $B_c$ cannot be moved off the display, and an attempt to do so causes the ball carrier and remaining blocker to remain stationary. If the players start in the positions of FIG. 5, for example, one operation of the up button 16 causes players $B_c$ and $B_2$ both to move up by one position. $B_1$ (which moves off the display) disappears. Further operation of the up button 16 causes no movement of the offensive players. If the down button 18 is then operated, offensive player $B_1$ will reappear in its original position, and players $B_c$ and $B_2$ will move back to theirs.

As was just explained, operation of any button once causes movement of the offensive players by one position; if a button is not pushed again, the offensive players remain stationary. This is not true of the defensive players; they begin motion in a variable manner when one of the directional buttons is first operated, and this motion continues regardless of whether further directional buttons are operated. This activity of the defensive players is caused by signals from the operational-circuit means 32, which is programmed to include means for moving the defensive players in a variable manner. This function is represented by block 36 of FIG. 2.

The defensive player to be moved is selected in a pseudo-random fashion. Of course, since the microprocessor is a completely determinate machine, the operation cannot be truly random. However, it is well known in the computer art to generate series of pseudo-random numbers. One of these types of methods is used by the defensive-motion means 36 to pick the defensive player to be moved. Once a defensive player is picked, a move is "randomly" picked from its repertoire of moves, and the move is executed on the display panel. The defensive-motion means then selects a player for the next move.

Each of the defensive players indicated by references a, b, c, d, and g in FIG. 5 has a repertoire that consists only of forward movements until the player symbol reaches the same "yardline" as the ball carrier. They then move up or down towards the ball carrier. Defensive players e and f have a different repertoire, moving up or down toward the ball carrier's row or moving left or right toward the ball carrier's column. For example, if defender e is in column D7 and row A, and if the ball carrier is in row B and column D1, then defender e can either move to the left or down, and the defensive-movement means picks one of these movements in a variable manner. (As previously indicated, the term variable manner is used here to denote the apparently random choice of players and moves).

According to the preferred embodiment of the present invention, the repertoire of a given defensive player depends upon the position of the ball carrier. Referring again to FIG. 5, all defensive players have the same repertoire as players e and f after the ball carrier reaches column D3.

One of the advantages of providing a multiplicity of offensive players is that blocking can be simulated. The operational-circuit means is programmed to provide this function, indicated in FIG. 2 by block 40, by detecting the coincidence on the field of an offensive player and a defensive player. According to the present invention, coincidence of a multiplicity of offensive players, not just of the ball carrier, can be detected independently, and this permits both blocking and tackling to be simulated. The apparatus of the preferred embodiment detects a coincidence between a defensive player and an offensive player other than the ball carrier and suppresses the display of both the offensive player and the defensive player until the end of the play. The end of the play occurs when there is a coincidence between the ball carrier itself and a defensive player. At that point motion stops, display of all players except the ball carrier is suppressed, and the unit must be reset by depressing the "D" button before a new play can be started.

Those skilled in the art will appreciate that the "coincidence" involved here will in most embodiments be merely incipient coincidence; it is often inconvenient in the preferred displays disclosed herein to simulate the simultaneous presence of different objects at the same place. According, appropriate programming will detect "attempts" by the machine to display two symbols in the same position, and "coincidence" is thus detected.

It can be seen that this provision of more than one offensive play symbol adds a new dimension to the game. With one offensive play symbol, of course, no blocking is possible. But a unit that provides a multiplicity of offensive play symbols permits provision to be made for detecting the independent coincidence of a multiplicity of offensive play symbols with a multiplicity of defensive player symbols, so blocking can be provided as well as tackling.

The operational-circuit means is further programmed to include means for monitoring the play action in order to record status information including the number of the down, the field position, the yardage needed for a first down, and the amount of time left in the game. This function is indicated by block 38 of FIG. 2. At the end of a down, the operator depresses the "D" key 24 to reset the unit for the start of the next play. Depressing the "D" button also causes the number of the down, the number of yards to go for first down, and the field position to be indicated on the playing-field portion of the display panel. An example of this is shown in FIG. 3, which shows third down, 13 yards to go on the six-yard line of the offense. The "u-6" means that the ball is at the offense's own six-yard line. Had the display read "d-6", the indication would be that the ball is at the defender's six-yard line.

Figure 4:
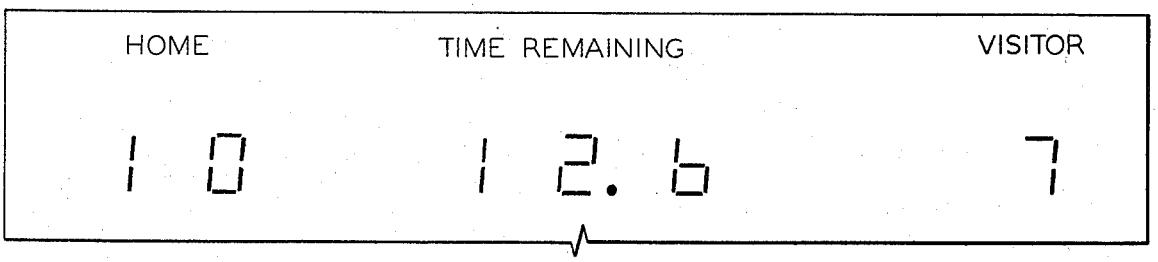
FIG. 4 is a simpler view of the same display showing the score and the amount of time remaining.

A second depression of the "D" button causes a display such as that shown in FIG. 4, in which the score and time remaining are indicated. As shown in FIG. 4, the score is 10 to 7 with 12.6 minutes of play remaining in the quarter. The end of the first quarter is indicated by an automatic display of the score without pressing the "D" button and a first-and-ten indication for the visiting team on its own twenty-yard line. The end of the game is indicated by the score and time being displayed automatically and the keyboard being disabled. In order to start a new game, the three-position switch 22 must be operated to OFF and then to position 1 or 2.

In order to execute a pass play, the pass/run switch 20 is operated to the "PASS" position. This puts the circuit into a mode in which it can simulate passes and indicate completions and interceptions. The programming for detecting pass completions and interceptions is indicated in FIG. 2. by block 42. According to the preferred embodiment, motion of the ball during a pass play is also simulated on the display panel 30, the ball-simulation programming being indicated by block 44 of FIG. 2.

Figure 8:
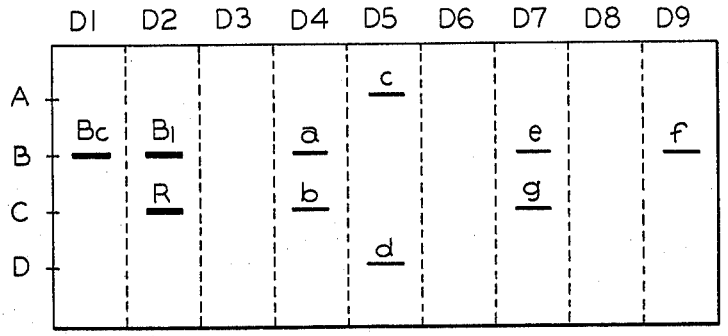
FIGS. 8, 9, 10, and 11 are simplified versions of the display showing the progress of a pass play.

In order to understand the way in which a pass play is displayed on the display panel 30, a perusal of FIG. 3 is requred. FIG. 3 shows that the display is an array 50 of LED segments. The array has nine columns of segments, and each column includes a standard seven-segment display digit and a decimal point. In addition, each column includes two horizontal segments located below the digit. Nineteen terminals 65 are located along the lower edge of the display panel, one for each column and one for each segment per column. In the first column, a standard seven-segment display is shown that is used during display of status information, but during play only two horizontal segments 52 and 56 are employed. The vertical segments as well as the middle horizontal segment 54 are not used while play action is being simulated. Further horizontal segments 60 and 62 positioned below the standard display digit 56 are not used during display of status information, but they are used during play-action simulation to show the positions of players. The decimal point 64 located to the right of the base of each digit is employed to simulate the flight of a ball during pass plays and kicks through sequential operation of adjacent decimal points. If the run/pass switch is in the "PASS" position, the players are initially lined up as shown in FIG. 8. The offensive player designated R in FIG. 8 is the receiver, player $B_1$ is a blocker, and the ball carrier is designated $B_c$. As in the running play, there is no movement on either side until one of the directional keys is operated. In the pass play, however, operation of a directional key does not cause the ball carrier $B_c$ or blocker $B_1$ to move; only the receiver R moves according to directions from the control board, and it moves independently of the other two offensive players.

When the receiver executes the first move, the defensive players begin to move, thereby placing the ball carrier in danger of being tackled. Though the blocker $B_1$ of FIG. 8 cannot be moved during a pass play, it can still perform its blocking function; if a defender attempts to reach the ball carrier by going through blocker $B_1$, the defender is taken out of the play, as is blocker $B_1$. The defender taken out of play can no longer be used to tackle the ball carrier, but the ball carrier has lost its blocker, and tackling after the block becomes easier.

The object of the pass play, of course, is to comlete a pass to the receiver. The ball is passed by depressing the pass/kick button 26, which causes the decimal points beginning at the position of the ball carrier to be illuminated in succession, thereby simulating the throwing of a pass. In order for the receiver to receive the pass, he must be in row B, the row occupied by the decimal points.

Figure 2:
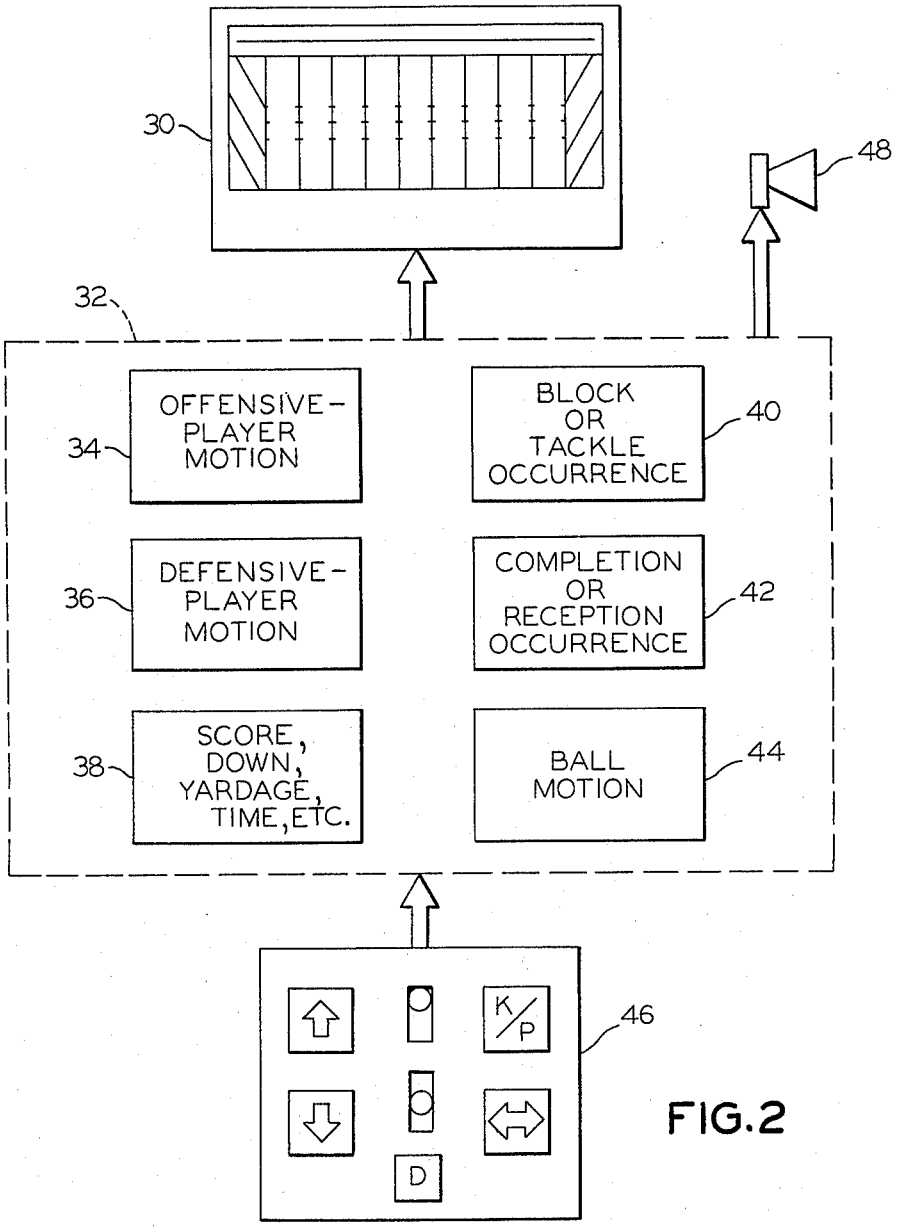
FIG. 2 is a block diagram showing the interdependence between the various functions of the apparatus of the preferred embodiment.
Figure 3:
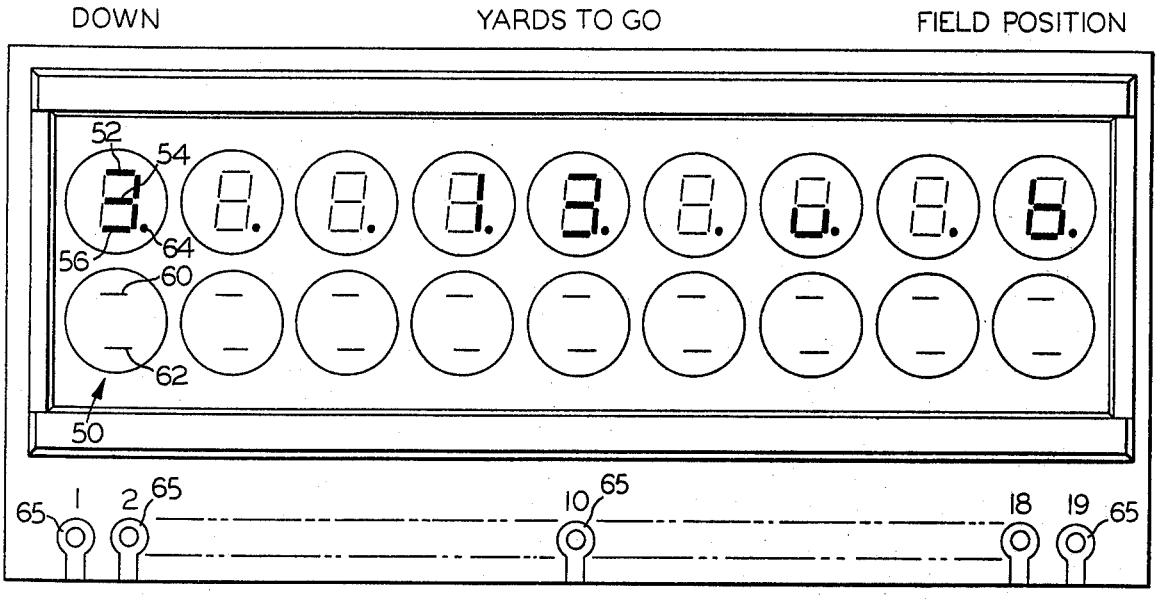
FIG. 3 shows the display panel of the preferred embodiment in detail, the display indicating the down, the yards to go for a first down, and the field position.

As suggested by blocks 42 and 44 of FIG. 2, the operational circuit is programmed to simulate the ball motion and to detect the coincidence of the ball and a receiver. When the receiver and the ball coincide, the receiver symbol starts blinking, thereby becoming a ball-carrier symbol. Movement of the new ball carrier is controllable from the control board until play stops as before upon the coincidence of a defensive player and the ball carrier.

The position of the ball is thus represented initially by a blinking ball-carrier symbol, then by the successively illuminated ball symbols, and finally by the blinking ball-carrier symbol again.

In a pass play the repertoires of the four forward defenders a, b, c, and d, and the fifth optional defender, g, are the same as they were in the running play, and these defenders still attempt to tackle the ball carrier. Defenders e and f, on the other hand, are pass defenders, and in the pass mode they only move forward in a variable manner until defender e reaches column D5; once defender e reaches column D5, its repertoire and that of defender f change, allowing them only to move up and down in a variable manner.

In addition to their different movement repertoires, defenders e and f also differ from the other defenders in that they have the capability of intercepting a pass. If the ball coincides with any of the other defenders there is no effect, either on the ball or on the defender; the coincident defender keeps up its variable-manner movement, and the ball continues on its way along row B. However, should the ball coincide with defender e or f, the completion/interception means 42 detects the coincidence, the ball disappears, and a turnover is effected.

At this point, it is to be remembered that the game is typically for use by two operators, one of whom controls the offensive players as they move to the right and the other of whom controls the offensive players as they move to the left. Thus, a turnover is effected by setting the players up on the next play in an orientation opposite to that on the previous play. For instance, assuming that the pass/run switch remains in the pass position, an interception occurring during a pass play that started in the position shown in FIG. 8 would cause the succeeding play to start in an arrangement that is the mirror image of FIG. 8. The ball carrier would start in row B, but in column D9 instead of D1, and the receiver, though starting in row C, would start in column D8 instead of D2. The positions of the other players would be similarly reversed.

The means for providing and moving the ball, represented by block 44 in FIG. 2, is also used on a kick play. When the run/pass switch is in the "RUN" position, which is also labeled "KICK," the pass/kick key 20 can also be operated, but it has no effect unless the monitoring means 38 has determined that it is a fourth-down play. If it is a fourth-down play, operation of the pass-/kick key 26 causes movement of the ball across the display. This movement of the ball simulates a kick, and the kick distance is assigned in a variable manner by the monitoring means 38. If the kick is determined by the monitoring means 38 to have been long enough, the offensive team is credited with a field goal. Otherwise, the position at which the erstwhile defensive side takes over the ball is determined by the yardage assigned to the punt.

It should be emphasized at this point that field position, as recorded by the monitoring means, has no effect on the position at which the line of scrimmage is simulated on the display panel; the ball carrier always starts the play in column D1 or D9, depending on which side has the ball. Thus, the position shown on the display at the end of a play represents only the amount of ground gained on the play, not the field position. The field position is indicated by the numeric characters resulting from operation of the "D" button 24.

Figure 7:
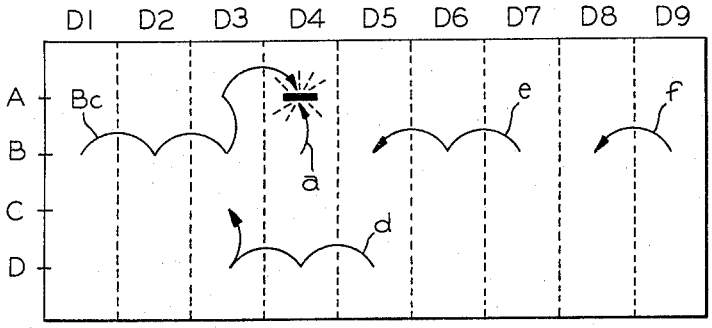
FIGS. 5, 6, and 7 show a simplified version of the display to illustrate the progress of a simulated running play.
Figure 6:
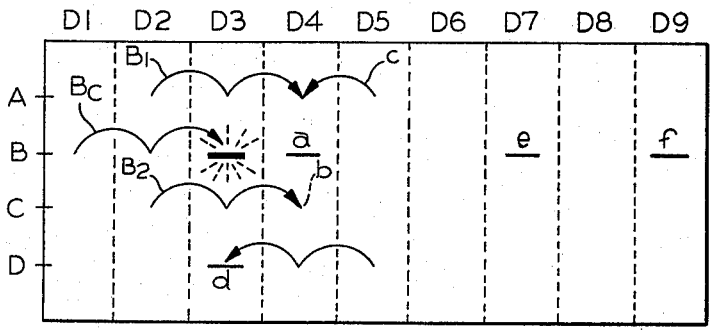

An example of a running play is shown in FIGS. 5–7. FIG. 5, as indicated previously, gives the normal lineup for a running play when the team advancing to the right has the ball. The ball carrier $B_c$ is in position in column D1 and row B, while blockers $B_1$ and $B_2$ are in column 2, rows A and C, respectively. Defenders a and b are in column D4, rows B and C, respectively, while defenders c and d occupy column D5, rows A and D, respectively. For purposes of the present illustration, it is assumed that the three-position switch 22 is in position 1, or the lower-skill position, which means that the defender g, which is not shown in FIGS. 6 and 7, is not present on the display. The position it would occupy in the skill-2 mode is shown in FIG. 5, however, and defenders e and g are shown occupying column D7, rows B and C, respectively. Finally, defender f is located in column D9, row B. FIG. 5 indicates the offensive players by lines that are heavier than those by which it indicates the defensive players. The heavier lines represent the fact that the offensive players are displayed more brightly. The ball carrier $B_c$ is further distinguished to represent the fact that it is blinking.

The players maintain the position shown in FIG. 5 until one of the directional buttons 16, 18, or 28 is depressed. As can be seen by referring to FIG. 6, button 28 is first pressed in the example, causing $B_c$, $B_1$, and $B_2$ all to move forward one space. The pressing of directional button 28 also causes the variable-manner motion of the defenders to start, which is accompanied by a periodic ticking sound emitted by the sound-generating device. The ticks represent the passing of time; the ticks occur approximately once per second in real time, but each represents one-tenth of a minute in simulated time. Up to three defensive moves can occur per tick until the ball carrier reaches column D3.

In addition to the provision of a seventh defensive player, the movement of the three-position switch 22 to position 2 results in a different rate of defensive movement. In both position 1 and position 2, up to three moves can occur per tick when the ball carrier is behind D3 in left-to-right movement or D7 in right-to-left movement. After the ball carrier has advanced beyond that point, however, the rate of defensive play when the switch is in position 2 greatly accelerates, occurring at a rate of up to twelve moves per second. However, if the three-position switch 22 is in position 1, the rate of defensive play remains at a limit of three movements per second.

As is shown in FIG. 6, three defensive moves occur during the time (in this case) taken by the operator to depress the downfield button 28 twice and move $B_c$, $B_1$, and $B_2$ forward two spaces. One of the defensive moves is the forward move of defender c. The motion of defender c occurs in a variable manner in the sense that defender c may or may not move, depending on the determination of the defensive-motion means 36. However, once it is determined that defender c will move, its repertoire in the situation shown in FIG. 6 only contains one move, the one shown in FIG. 6. As was mentioned before, defender c can only move along a row until it arrives at the same column as that occupied by the ball carrier $B_c$. It is only when defender c reaches the same column as that of the ball carrier $B_c$ that it can move vertically toward the ball carrier $B_c$.

It is to be noted in FIG. 6 that blocker $B_1$ and defender c are only shown by arrows that point to the same position. This is to indicate that, the blocker and defender having moved to the same position, their coincidence was detected by a coincidence-detection means indicated by reference 40 in FIG. 2, and their display was therefore suppressed. Blocker $B_2$, which also moved in tandem with the ball carrier $B_c$, also encountered a defender, and its display and that of defender b was also suppressed.

Of the remaining defenders, defender d executed two forward moves, the only moves in its repertoire at that point, and defenders e and f were not chosen for movement by the defensive-motion means indicated by reference 36 in FIG. 2.

FIG. 7 shows the next moves executed by the ball carrier in response to commands from the control board. The first command resulted from the depression of the up button 16, which caused the ball carrier $B_c$ to move from row B to row A in column D3. Before the operator pressed directional button 16, however, defenders e and f moved, e moving forward two spaces and f moving forward one space. Though the repertoires of defensive players e and f include both forward movements toward the column occupied by the ball carrier $B_c$ and up or down movements toward its row, the only choice in the situation presented by FIG. 7 was forward, since at the time of motion both defenders e and f were already in the same row as ball carrier $B_c$.

After the movements of defenders e and f, the ball carrier made its move upward, and this was followed by the movement of defender d. As previously indicated, defender d can only move forward until it reaches the column occupied by the ball carrier. In FIG. 7, however, defender d already occupies the same column as the ball carrier, so the only move open to it is up from row D to row C in column D3 as shown. The move of defender d was followed by a command from the control board resulting from the operation of directional button 28, causing the ball carrier $B_c$ to move forward in row A from column D3 to column D4. At that point, defender a was chosen in a variable manner, and the only move open to it was upward toward the ball carrier. This caused a coincidence between defender a and the ball carrier $B_c$, which was detected by the coincidence-detection means represented by block-or-tackle box 40 of FIG. 2. Play action was accordingly stopped, and display of all players except the ball carrier was suppressed, as seen in FIG. 7. The sound-generating device was operated to simulate a whistle blast, indicating the termination of play action at the position of the ball carrier $B_c$, whose display remained at the end of play action to indicate the amount of yardage gained on the play. In FIG. 7 the amount of yardage gain indicated by the position of the ball carrier $B_c$ is one yard. If the ball carrier had been tackled in column D1, a loss of two yards would have resulted; column D2 indicates a loss of one yard, D3 indicates no yards gained, D5 indicates two yards gained, D6 indicates three yards gained, D7 indicates four yards gained, D8 indicates five yards gained, and D9 indicates six yards gained. This information is stored by the monitoring means indicated by box 38 of FIG. 2, and when the operator presses the "D" button 24, the monitoring means takes this information into consideration in computing the field position that is displayed on the playing-field area of the display. The number of ticks, each of which indicates the passing of a simulated tenth of a minute, is also stored by the monitoring means, which takes this information into account in displaying the amount of time remaining if the operator again presses the "D" button.

Figure 9:
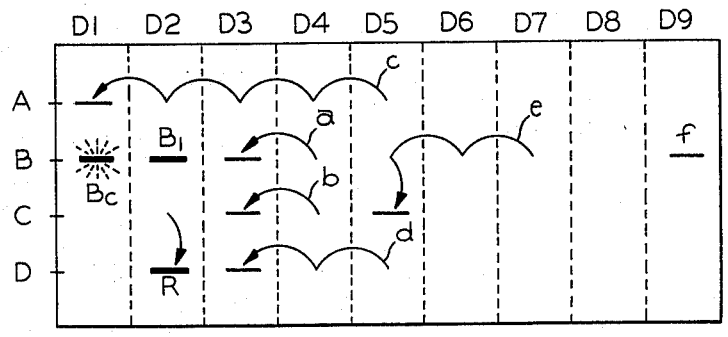

Should the operator switch the pass/run switch to the "PASS" position, the lineup will change to that shown in FIG. 8, in which the ball carrier $B_c$ and blocker $B_1$ occupy row B, columns D1 and D2, respectively. The other offensive player is now called the receiver and occupies row C, column D2. The defensive players occupy the same initial positions that they occupy at the beginning of a running play. The pass play in FIG. 9 is initiated by operation of down button 18, which causes the receiver to move down from row C to row D in column D2. As before, this begins the motion of the defensive players, and in the FIG. 9 example defender d immediately moves forward two spaces. The operator attempts to move the receiver forward by operating directional key 28, but the incipient coincidence is detected, and separation between the receiver and the defender is maintained by the receiver's being prevented from moving forward. As the operator contemplates his next move, defender c moves forward four spaces. As was indicated previously, defender c can only move along a row toward the ball carrier's column at this point, so the picking of defender c for movement necessitates forward moves as shown in FIG. 9. Similar considerations require defender a to move forward when it is picked, and defender b is similarly constrained.

Defender e's pass-play repertoire requires that it moves forward (along a row) toward the receiver's row until it reaches column D5. Once it reaches column D5, its repertoire consists of up or down movements along column D5. Defender f is also affected by the position of defender e; its repertoire changes from movement along a row to up or down a column at the same time as defender e's does.

Following the above rules, defender e is picked for three moves, by the first two of which it is placed in column D5. This changes its repertoire to up-or-down movements. It should be emphasized that upon arriving at row B, column D5, defender e has the option of moving up or down because its pass-play repertoire is not restricted to movements toward the receiver once it reaches column D5. Nonetheless, the movement of defender e in FIG. 9 upon arriving at column D5 is shown as being down, toward the row occupied by the receiver.

Figure 10:
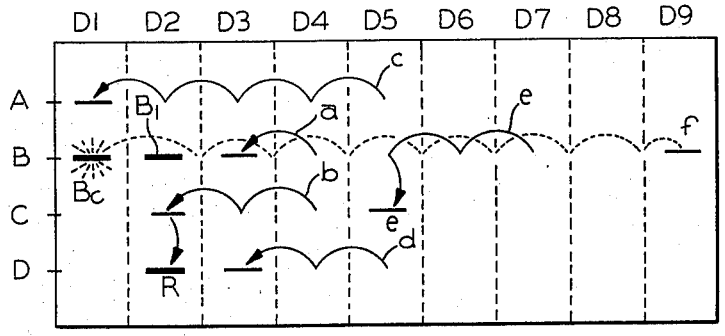

FIG. 10 illustrates the moves that follow those in FIG. 9. The operator, upon realizing that the receiver cannot move forward, decides to press the up button 16 in order to move the receiver to row B. Before he presses the button, however, defender b is picked twice for movement and executes forward steps, the only movements available in its repertoire at that position. This completely blocks the receiver, leaving the operator with no options for moving the receiver other than to wait until defender b has moved past. However, defender c is dangerously close to the ball carrier $B_c$, and one movement by defender c would result in the ball carrier being tackled, resulting in a loss of two yards.

The operator resolves to throw the ball away, so he presses the pass/kick key. This causes the operational-circuit means 32, which is programmed, as indicated by block 44, to provide a ball display, to place a ball symbol on the display and to move it to the right from the ball-carrier position. As noted above, the ball movement is accomplished by successively lighting adjacent decimal-point segments on the display. On its first movement, the ball coincides with blocker $B_1$. The operational-circuit means is programmed to detect coincidence between the ball and certain players, as is suggested by box 42 of FIG. 2. However, blocker $B_1$ is not one of the players whose coincidence with the ball is to be detected, and the ball continues on its way, unaffected by the presence of blocker $B_1$. The ball also encounters defender a, but defender a also is not one of the players whose coincidence with the ball is to be detected. Coincidence is only to be detected between the ball and either receiver R or one of the pass defenders e or f. The ball thus continues downfield, finally coinciding with defender f. Since defender f is a pass defender, the means indicated by box 42 in FIG. 2 causes an interception to be indicated. Though the players are still shown in FIG. 10, the result of an interception is the suppression of all of the players. Another indication of the interception is a three-whistle blast, simulated by the sound-generating device, which indicates a turnover. Another turnover indication is that the offense moves to the left rather than to the right when the players are lined up again, i.e., in the opposite direction.

Figure 11:
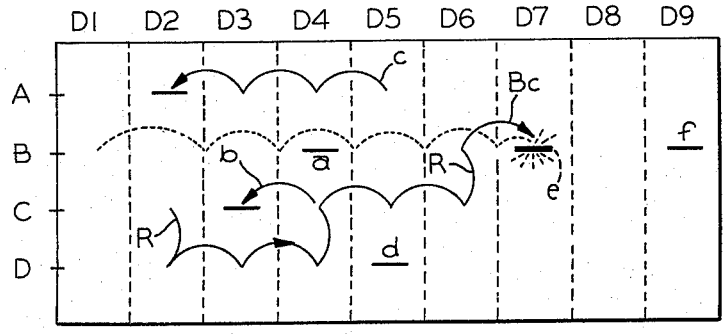

FIG. 11 shows a more successful pass play, again assuming the initial position shown in FIG. 8. Action is begun by depressing directional down button 18, which moves the receiver down to row D. The operation of directional key 18 is followed by two successive operations of downfield button 28, which advances the receiver to column D4, row D. Concurrently with these offensive plays, defensive player c executes three forward moves. Again, the repertoire of defensive player c is limited at this point to forward movements toward the ball carrier's column.

Upon reaching row D, column D4, the receiver is boxed in by defenders b and d. However, defender b, which keys on the ball carrier, not the receiver, obligingly moves forward one space, allowing the operator to operate up button 16, which moves the receiver up into row C. The receiver then advances two spaces in row C to column D6, and up button 16 is then operated to move the receiver up into row B. It is necessary for the receiver to be moved into row B because reception of a pass can only be accomplished in row B; row B is the only row with decimal points. The receiver having been maneuvered into row B, the pass/kick button 26 is operated, causing the ball to move forward as was illustrated in FIG. 10. Though the ball carrier $B_c$ and the blocker $B_1$ were both shown in FIG. 10 for clarity, the operational circuit actually suppresses their display after a pass has been thrown. This is indicated in FIG. 11 by the absence of ball carrier $B_c$ and blocker $B_1$.

As shown in FIG. 11, the ball continues on its journey, encountering defensive player a, which cannot intercept the pass, and continuing until it encounters receiver R. The coincidence between the ball and receiver R is detected, and a reception is indicated by the replacement of the steady receiver signal with the blinking ball-carrier signal. The operator then chooses to press downfield 28, causing the ball carrier to run right into defensive player e, resulting in a tackle. As is not shown in FIG. 11, all of the players are suppressed except the ball carrier, which remains on the display in column D7, thereby indicating a gain of four yards on the play. Again, the monitoring means records the gain on the play and the number of ticks of the clock that have occurred during play action and employs this information in generating the status displays triggered by pressing the "D" button.

Further features are also programmed into the device. One provided in the preferred embodiment is the playing of a simulated fight song upon the occurrence of a score. Another is the provision of variable yardage on kicks. As indicated before, a punt can be simulated on fourth down, and in the preferred embodiment the device assigns a variable distance to the punt, the distance having a nearly Gaussian distribution centered on 35 yards. A punt whose distance exceeds that to the goal line will result in a field goal, which is scored as 3 points. However, a punt from 25 yards out does not guarantee that a field goal will result, and the fact that the kick occurs from the 50-yard line does not ensure that the field-goal attempt will be unsuccessful. Thus, the provision of a variable kick distance adds a measure of realism to the game.

Another provision that provides realism is the awarding of a safety when a team loses yardage in its own end zone. Two points are awarded the other team, which receives the ball and a first down on its 20-yard line. In the illustrated embodiment, points after touchdown are not played; seven points are automatically awarded for touchdowns.

Figure 12A:
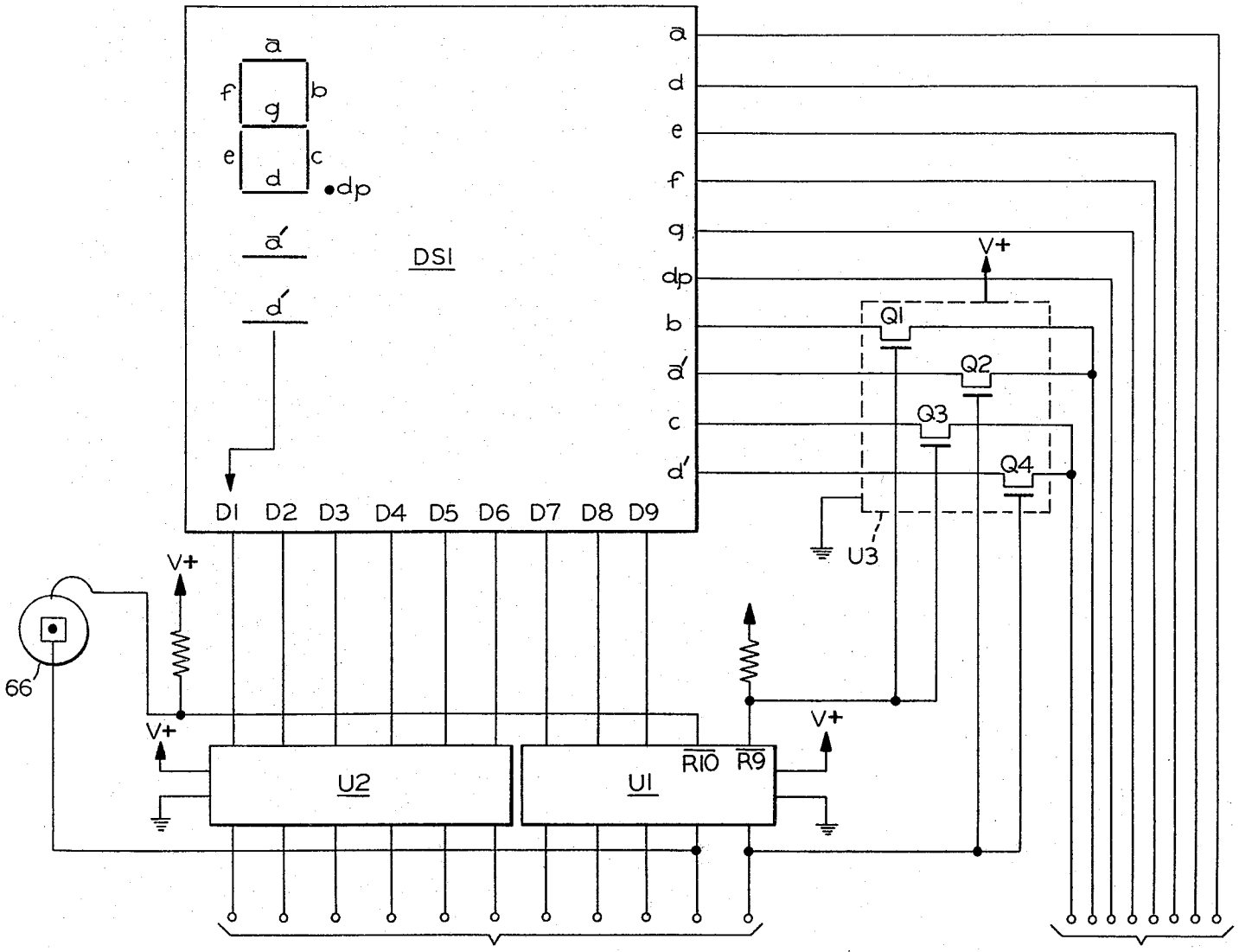
FIGS. 12A and 12B together form a schematic diagram showing a typical circuit for realization of the apparatus of the present invention.
Figure 12B:
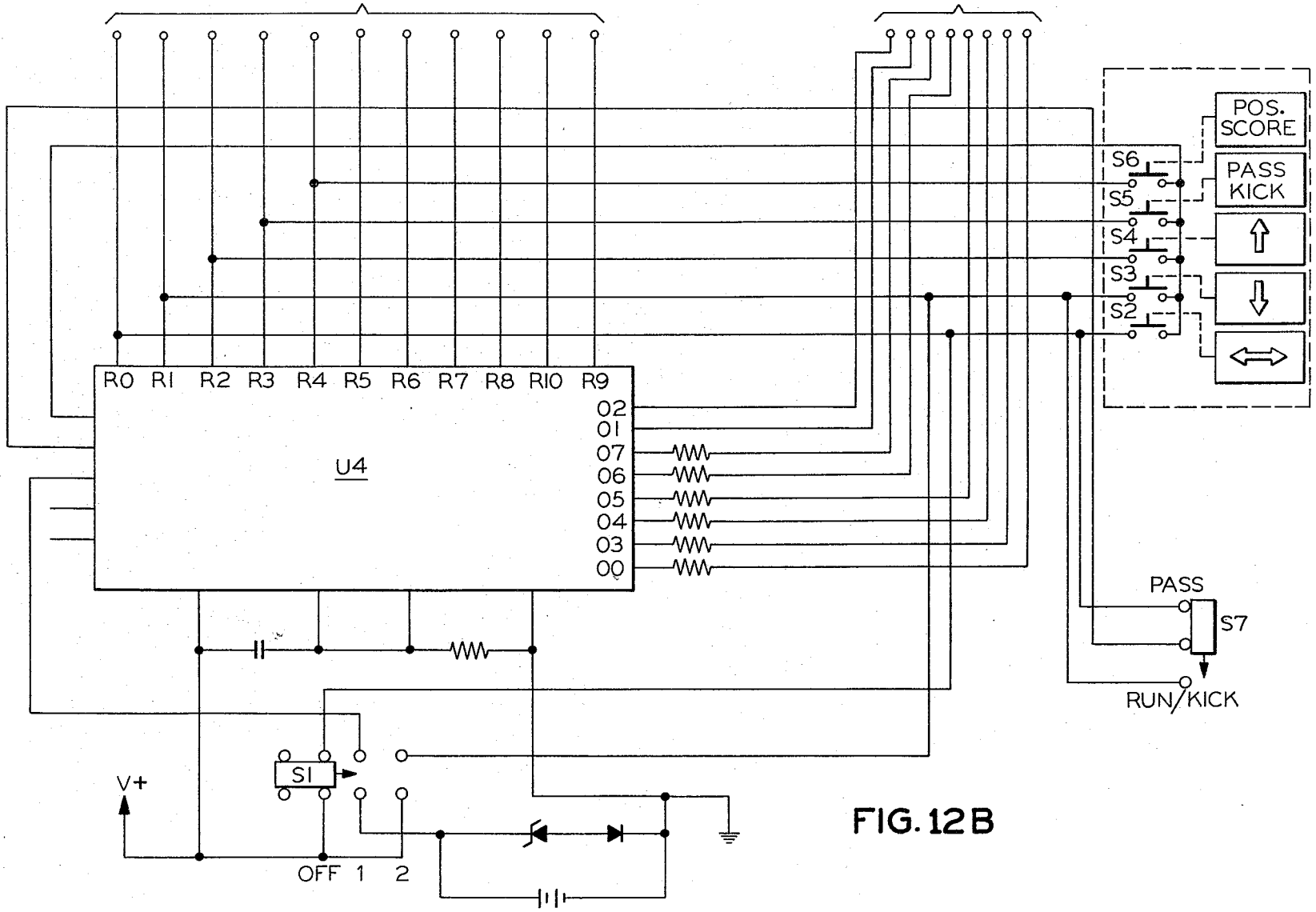

FIGS. 12A and 12B together form a schematic diagram of one circuit that can be used for realization of the preferred embodiment of the present invention. Bracketed groups of terminals in FIG. 12A represent the same circuit nodes as corresponding terminal groups in FIG. 12B. The elements of the schematic will be described generally; no attempt is made here to describe specifically the signals present on all of the lines in the schematic, because those skilled in the art will understand the operation from the designations of the functional elements.

The heart of the exemplary circuit is a single-chip microprocessor U4, a Texas Instruments TMS 1100, which has been programmed to provide the functions detailed above by mask programming a 2k ×4-bit-read-only memory. As will be understood by those skilled in the art, the final mask is developed in accordance with the purchaser's specifications.

Shown in FIG. 12A is the LED display DS1. DS1 is a display having the arrangement shown in FIG. 3. It is similar to commercially available seven-segments displays, but the a' and d' segments are the only ones present in the lower row of digits. The terminals labeled D1 through D9 on DS1 are column-selection terminals. Application of the appropriate level to one of these terminals enables further signals applied at the terminals labeled a through d' to light appropriate segments in the column. For instance, if it is desired to light segments a and d of the first column in FIG. 3, a signal is applied to terminal D1 of DS1 (FIG. 12A), and the appropriate signals are also applied simultaneously to terminals a and d. The terminals are driven according to signals produced by microprocessor U4 at its terminals labeled R0 through R10 and O0 through O7. The signals from micrprocessor U4 that drive the column-selection terminals of the display are applied through driver chips U1 and U2 of FIG. 12A. The driver chips invert the signals applied to them and reduce the loading of the microprocessor outputs at terminals R0 through R10.

Operation of the segment-selection terminals of DS1 is controlled by means of output signals appearing on terminals R9 and O0 through O7 of U4. Since the specific chip U4 employed in the exemplary circuit does not have enough output lines to directly provide all of the inputs to the display DS1, gating circuits U3 (FIG. 12A) are provided. U3 allows the signals on terminals R9, 02, and 01 to provide four display inputs instead of three. For example, illumination of segment b' without illumination of segment a' requires that the appropriate signal be applied by the microprocessor U4 to its terminal 01 and consequently to the source terminals of Q1 and Q2 in chip U3. Simultaneously, the microprocessor U4 also provides an appropriate signal at terminal R9 that is applied to the gate of Q2 to prevent it from conducting. The complement of the signal on terminal R9 of the microprocessor U4 appears at output terminal $\overline{R9}$ of driver chip U1 and is applied to the gate of Q1 of chip U3, permitting it to conduct and to allow the signal from terminal 01 of microprocessor U4 to appear at terminal b of the display DS1. Segments b in the enabled columns are thereby illuminated while terminals a' in the same columns are not.

The other major components of the schematic are the battery BT1, which supplies power to the circuitry, the switches S1 through S7, which also appear in FIG. 1, and a piezoelectric transducer 66, the sound-generating device that provides the various sound indications previously mentioned. As can be deduced from FIGS. 12A and 12B, the complementary signals on terminal R10 of the microprocessor U4 and $\overline{R10}$ of the driver chip U1 are applied across the piezoelectric transducer 66 at various frequencies to produce the desired sound signals. The battery, of course, powers the unit, and it is apparent from FIGS. 12A and 12B that the switches can be operated to enter signals into the microprocessor chip U4, it being within the knowledge of those skilled in the art to program the microprocessor to interpret the entered signals.

The remaining discussion explains the method of maintaining a complete roster of players on the LED display DS1 at any given time. As was indicated above, a signal on, say, terminal a of the display DS1 will illuminate the a segments on all of the columns enabled by appropriate signals on terminals D1 through D9 of the display DS1. Thus, it would appear that the appropriate way to light a segments in columns D2, D5, and D7 at the same time would be to apply signals simultaneously to their enabling terminals. However, this would cause a problem if it were also desired to illuminate the d segment of column D1 alone, because a signal on the d terminal would also cause d segments in enabled columns D2, D5, and D7 to light. In order to avoid this the display is multiplexed. That is, no two columns are displayed at the same time; as a matter of fact, different parts of the same column are driven at different times. But the columns are all displayed frequently enough so that their illuminations appear steady. By appropriate timing, this multiplexing effects the differences in brightness between the offensive players and the defensive players; the segments representing defensive players are pulsed less frequently than those that represent offensive players, so the defensive players appear to be dimmer.

In light of the foregoing description, it can be appreciated that the provision of a multiplicity of offensive players affords numerous advantages, particularly if more than one offensive player is permitted to be moved at a time. The use of more than one offensive player permits a passing game and enhances the running game by providing blockers. Other advantages of the device illustrated above include the provision of a display simulating a ball, which allows visual representations of passes and kicks. Additionally, the provision of status information on the same part of the display panel as that occupied by the playing field permits a display to be provided using a minimum of display area.

Having thus described the invention, I claim:

1. In an apparatus for simulating a sports action team game, the combination comprising:

a. a hand-holdable housing;

b. a display panel on the upper surface of said housing and including a visual simulation of a playing field of the type on which a ball-type game is played and adapted to display symbols in response to electrical signals applied thereto;

c. operational-circuit means in said housing operatively connected to said display panel for generation and transmission of electrical signals to said display panel to produce on said simulated playing field a multiplicity of offensive play symbols and a multiplicity of defensive-player symbols, one of said offensive play symbols at a time simulating the position of the ball, said operational-circuit means including:

(i) means for moving a multiplicity of said offensive play symbols in a controlled manner along said playing field including means for concurrently moving a plurality of said symbols generally in a common direction along said playing field;

(ii) means for concurrently moving a plurality of said defensive-player symbols along said playing field in a variable manner towards the ball-position symbol, movement of said offensive play symbols and defensive-player symbols providing play action simulating the action of said sports action team game;

(iii) means for detecting the independent coincidence of a multiplicity of offensive play symbols with a multiplicity of defensive-player symbols, said detecting means terminating play action upon detection of a coincidence of said ball-position symbol with any one of a selected multiplicity of said defensive- player symbols, said detecting means permitting continuation of play action upon detection of coincidence with a defensive-player symbol of an offensive play symbol other than said ball-position symbol and said detecting means limiting the movement of at least some of said coincident defensive-player symbols coincident with an offensive play symbol other than said ball symbol towards said ball-position symbol to simulate "blocking" of the defensive-player symbol; and (iv) means for monitoring play action to record information concerning the status of said simulated game and for producing signals indicative of said status information, said signals being transmitted to said display panel to display said status information on said display panel; and d. a control board on said housing including a multiplicity of manually operable control elements, said control board being connected to said operational-circuit means for transmission of signals to said operational-circuit means through operation of said control elements, said offensive-movement means producing manually controlled movement of said multiplicity of offensive play symbols in response to signals transmitted from said control board, said control elements including means for operating said game apparatus in a selected one of at least two play action modes, (i) one of said modes being a "rushing" mode in which said control board and control means interact to simulate "running" action of the ball-position symbol, one of said manually operable control elements transmitting signals to said control means which includes means operating upon said offensive play symbol movement means to effect concurrent movement of the ball-position symbol and at least one other offensive play symbol generally in a common direction along said playing field as the operator manually operates the control elements to effect movement of the ball-position symbol through the defensive-player symbols, said detecting means limiting the movement of said defensive-player symbols towards the ball-position symbol upon detection of coincidence thereof with said other concurrently moving offensive play symbols to simulate "blocking" thereof by said other concurrently moving offensive play symbols, said detecting means terminating play action upon detection of coincidence of a defensive-player symbol with said ball-position symbol; and (ii) another mode being a "passing" mode in which said control board and control means interact to simulate the "passing" of the ball-position symbol to a maneuverable "receiver", at least one of said manually operable control elements transmitting signals to said operational-circuit means which includes means operating upon said offensive play symbol movement means to effect movement of an offensive play symbol representing an intended "receiver", the operator manually operating the control elements to move the "receiver" symbol and ball-position symbol into an aligned position to execute a pass, said detection means precluding movement of the "receiver" symbol to a position occupied by a defensive-player symbol, said operational-circuit means also including means operating upon said offensive play symbol movement means to effect advance of said ball-position symbol along a linear path upon actuation of a manually operable control element, said operational-circuit means including means for detecting coincidence of the advancing ball-position symbol and "receiver" symbol to represent a completed "pass", said operational-circuit means including means for detecting coincidence of the advancing ball position symbol and at least a selected one of said defensive-player symbols to represent an "intercepted pass".

2. The apparatus combination of claim 1 wherein said coincidence-detection means suppresses, upon coincidence between a defensive-player symbol and an offensive play symbol other than said ball-position symbol, display of said coincident defensive-player and offensive play symbols until termination of play action.

3. The apparatus combination of claim 1 wherein said control board includes a skill level control element for selecting the number of defensive-player symbols and said operational-circuit means generates and transmits signals to said display panel to produce a number of defensive-player symbols at the beginning of play action that depends on signals from said skill level control element.

4. The apparatus combination of claim 1 wherein said defensive movement means moves some of said defensive-player symbols in a variable manner towards said "receiver" symbol and others of said defensive-player symbols towards said ball-position symbol.

5. The apparatus combination of claim 1 wherein said operational circuit means generates and transmits signals to said display panel to produce symbols simulating players whose orientations with respect to each other at the beginning of play action is dependent upon signals transmitted from said control element means for operating the apparatus in a selected game mode.

6. The apparatus combination of claim 1 wherein said defensive-movement means moves each of said defensive-player symbols according to moves selected from a repertoire of possible moves, and wherein said defensive-player symbols are divided into at least two groups in each of said modes of play, each group having a different repertoire of possible moves, one group in said passing mode concentrating on the "receiver" symbol and another group in said passing mode advancing on the ball-position symbol, one group in said "running" mode remaining behind the initial line between the teams and another group advancing on the ball-position symbol.

7. The apparatus combination of claim 6 wherein said one group in each of said modes has a repertoire that depends on the position on said display panel of at least one of said offensive play symbols, said one offensive play symbol being the "receiver" symbol in the "passing" mode and the ball-position symbol in the "running" mode and said position being a position advanced beyond the initial line between the teams.

8. The apparatus combination of claim 1 wherein said defensive-movement means moves said defensive-player symbols at a rate that is dependent on the position on said display of at least one of said offensive play symbols, the speed of movement being greater when the ball-position symbol crosses the initial line between the teams.

9. The apparatus combination of claim 1 wherein said control board includes a skill level control element for selecting the speed of movement of defensive-player symbols and said operational-circuit means generates and transmits signals to said defensive-movement means to move said defensive-player symbols at a rate that depends on signals transmitted from said skill level control element.

10. The apparatus combination of claim 1 wherein said offensive-movement means is arranged to produce manually-controlled movement of said "receiver" symbol after "completion" of a simulated "pass", manual control over the simulated pass "receiver" thereby being afforded.

11. The apparatus combination of claim 1 wherein, in said running mode, said defensive-movement means is actuated only upon manually controlled movement of the ball-position symbol.

12. The apparatus combination of claim 1 wherein said operational-circuit means transmits signals to said display panel to produce a ball-position symbol which differs in appearance from that of the rest of said offensive play symbols, advance of said ball position symbol to the "receiver" symbol to simulate a pass completion being indicated by replacement of said coincident "receiver" symbol with said ball-position symbol.

13. The apparatus combination of claim 1 wherein the appearance of said ball-position symbol during "pass" simulation differs from its appearance at other times, said ball-position symbol thereby simulating a ball during its advance in "pass" simulation and a ball carrier at other times.

14. In a method for simulating a sports-action team game, the steps comprising:

a. providing a hand-holdable housing having a display panel including a simulated playing field of the type on which a ball-type game is played and adapted to display symbols in response to electrical signals applied thereto;

b. generating and transmitting electrical signals to said display panel to produce on said simulated playing field a multiplicity of offensive play symbols and a multiplicity of defensive-player symbols, one of said offensive play symbols at a time simulating the position of the ball;

c. providing means for moving a multiplicity of said offensive play symbols along said playing field under manual control;

d. selecting one of at least two play action modes, one of said modes being a "rushing" mode which simulates the "running" action of the ball-position symbol, and another mode being a "passing" mode which simulates the "passing" of the ball-position symbol to an intended "receiver" symbol;

e. moving at least a selected one of said offensive play symbols by manipulation of said manual control means, said moved offensive play symbols in the "running" mode being the ball-position symbol and at least one other offensive play symbol simulating a "blocker";

f. moving concurrently a plurality of said defensive-player symbols in a variable manner towards the ball-position symbol, movement of said offensive play symbols and defensive-player symbols providing play action simulating the action of said sports action team game;

g. detecting the independent coincidence of a multiplicity of offensive play symbols with a multiplicity of defensive-player symbols and terminating play action upon the detection of coincidence between said ball-position symbol with any one of a selected multiplicity of defensive-player symbols;

h. when in said running mode, prohibiting the movement towards said ball-position symbol of at least some of said coincident defensive-player symbols coincident with an offensive play symbol other than said ball-position symbol to simulate "blocking" of the defensive-player symbols;

i. when in said passing mode, moving said "receiver" symbol through the defensive-player symbols and aligning said "receiver" symbol with said ball-position symbol, and thereafter advancing the ball-position symbol along a linear path towards the "receiver" symbol, coincidence of said ball-position symbol with said "receiver" symbol repesenting a "completed" pass and coincidence of said advancing ball-position symbol with at least a selected one of said defensive-player symbols representing an "intercepted" pass;

j. monitoring play action to record information concerning the status of said simulated game; and k. displaying said status information.

15. The method of claim 14 wherein said step of limiting the movement of said coincident defensive-player symbol includes suppressing display of said coincident defensive-player and offensive play symbols until termination of play action.

16. The method of claim 14 wherein said step of moving said defensive-player symbols includes moving defensive-player symbols divided into at least two groups in each of said modes of play, each group having a different repertoire of possible moves, one group in said passing mode concentrating on the "receiver" symbol and another group in said passing mode advancing on the-ball position symbol, one group in said "running" mode remaining behind the initial line between the teams and another group advancing on the ball-position symbol, and moving said groups of defensive-player symbols according to moves selected from said repertoires.

17.The method of claim 6 wherein said step of moving said defensive-player symbols according to said possible moves selected from said repertoires includes moving some of said defensive-player according to moves selected from a repertoire that depends on the position on said simulated playing field of one of said offensive play symbols, said one offensive play symbol being the receiver symbol in the "passing" mode and the ball position symbol in the "running" mode and said position being a position advanced beyond the initial line between the teams.

18. The method of claim 7 wherein said step of moving said defensive-player symbols includes moving said defensive-player symbols at a rate that depends on the position on said display of said ball-position symbol, the speed of movement being greater when the ball-position symbol crosses the initial line between the teams.

19. The method of claim 14 wherein the step of prohibiting movement of said "blocked" defensive-player symbols comprises suppressing the display of the coincident offensive play and defensive-player symbols.

20. The method of claim 14 additionally including the step of selecting a skill level for the play action of said game, said skill level selection controlling the number of defensive-player symbols generated on said simulated playing field.

21. The method of claim 14 wherein some of said defensive-player symbols are moved in a variable manner towards said "receiver" symbol and other of said defensive-player symbols are moved towards said ball-position symbol.

22. The method of claim 14 additionally including the step of selecting a skill level which controls the speed of movement of at least some of said defensive-player symbols.

23. The method of claim 14 wherein the step of detecting coincidence between said ball-position symbol and said selected at least one of said defensive-player symbols includes indicating a simulated pass "interception" when there is detected coincidence between said selected at least one of said defensive-player symbols and the advancing ball-position symbol during "pass" simulation.

24. The method of claim 14 wherein said step of moving said offensive-player symbols includes continuing motion of at least one of said offensive play symbols by manipulation of said manual control means after detection of a simulated pass "completion", said one offensive play symbol being the symbol resulting from coincidence of said advancing ball-position symbol and said "receiver" symbol.

25. The method of claim 14 wherein said ball-position symbol is distinct in appearance from the rest of said offensive play symbols; and further including the step of replacing the "receiver" symbol with a ball-position symbol upon detection of coincidence, thereby indicating the occurrence of a simulated completed pass.

26. In an apparatus for simulating a sports action team game, the combination comprising:

a. a hand-holdable housing;

b. a display panel on the upper surface of said housing and including a visual simulation of a playing field of the type on which a ball-type game is played and adapted to display symbols in response to electrical signals applied thereto;

c. operational-circuit means in said housing operatively connected to said display panel for generation and transmission of electrical signals to said display panel to produce on said simulated playing field a multiplicity of offensive play symbols and a multiplicity of defensive-player symbols, one of said offensive play symbols at a time simulating the position of the ball, said operational-circuit means including:

(i) means for concurrently moving a multiplicity of said offensive play symbols in a controlled manner along said playing field, said multiplicity of symbols including said ball-position symbol and at least one other offensive play symbol, said movement being generally in a common direction along said playing field;

(ii) means for concurrently moving a plurality of said defensive-player symbols along said playing field in a variable manner towards the ball-position symbol, movement of said offensive play symbols and defensive-player symbols providing play action simulating the action of said sports-action team game;

(iii) means for detecting the independent coincidence of a multiplicity of offensive play symbols with a multiplicity of defensive-player symbols, said detecting means terminating play action upon detection of a coincidence of said ball-position symbol with any one of a selected multiplicity of defensive-player symbols, said detecting means permitting continuation of play action upon detection of coincidence with a defensive-player symbol of an offensive play symbol other than said ball-position symbol and said detecting means prohibiting the movement of said defensive-player symbol coincident with said offensive play symbols other than said ball-position symbol towards said ball-position symbol to simulate "blocking" of said last-mentioned defensive-player symbol;

(iv) means for monitoring play action to record information concerning the status of said simulated game and for producing signals indicative of said status information, said signals conveying the recorded information to the operator of the game; and d. a control board on said housing including a multiplicity of manually operable control elements, said control board being connected to said operational-circuit means for transmission of signals to said operational-circuit means through operation of said control elements, at least one of said manually operable control elements transmitting signals to said offensive-movement means and producing manually controlled movement of at least said ball-position symbol in response to signals transmitted from said control board, said operational circuit means including means operating upon said offensive play symbol movement means to effect concurrent movement of the ball-position symbol with at least one other offensive play symbol in a generally common direction as the operator manually operates the control elements to effect movement of the ball-position symbol through the defensive-player symbols, said detecting means prohibiting the movement of said defensive-player symbols towards said ball-position symbol upon detection of coincidence of said defensive-player symbols with said other concurrently moving offensive play symbols and said detecting means terminating play action upon coincidence of any one of said selected multiplicity of defensive-player symbols with said ball-position symbol.

27. The apparatus combination of claim 26 wherein said coincidence-detection means suppresses, upon detection of a coincidence between a defensive-player symbol and an offensive play symbol other than said ball-position symbol, display of said coincident defensive-player and offensive play symbols until termination of play action.

28. The apparatus combination of claim 26 wherein said defensive-movement means is actuated only upon manually controlled movement of the ball-position symbol.

29. The apparatus combination of claim 26 wherein said control board includes a skill level control element for selecting the speed of movement of defensive-player symbols and said operational-circuit means generates and transmits signals to said defensive-movement means to move said defensive-player symbols at a rate that depends on signals transmitted from said skill level control element.

30. The apparatus combination of claim 26 wherein said control board includes a skill level control element for selecting the number of defensive-player symbols and said operational-circuit means generates and transmits signals to said display panel to produce a number of defensive-player symbols at the beginning of play action that depends on signals from said skill level control element.

31. In an apparatus for simulating a sports action team game, the combination comprising:

a. hand-holdable housing;

b. a display panel on the upper surface of said housing and including a visual simulation of a playing field of the type on which a ball-type game is played and adapted to display symbols in response to electrical signals applied thereto;

c. operational-circuit means in said housing operatively connected to said display panel for generation and transmission of electrical signals to said display panel to produce on said simulated playing field a multiplicity of offensive play symbols and a multiplicity of defensive-player symbols, one of said offensive play symbols at a time simulating the position of the ball, said operational-circuit means including:

(i) means for moving a multiplicity of said offensive play symbols along said playing field, said means including means for advancing said ball-position symbol in a linear path along said simulated playing field to simulate a ball being passed and for independent movement of at least one other offensive play symbol to simulate a "receiver";

(ii) means for concurrently moving a plurality of said defensive-player symbols along said playing field in a variable manner towards the ball-position symbol, movement of said offensive play symbols and defensive-player symbols providing play action simulating the action of said sports-action team game;

(iii) means for detecting the independent coincidence of a multiplicity of offensive play symbols with a multiplicity of defensive-player symbols, said detecting means terminating play action upon detection of coincidence of said ball-position symbol with any one of a selected multiplicity of said defensive-player symbols and, during simulation of a pass, with at least a selected one of said defensive-player symbols, said detecting means permitting continuation of play action upon coincidence with a defensive-player symbol of an offensive play symbol other than said ball-position symbol and upon coincidence of said ball-position symbol with a defensive-player symbol other than said selected at least one of said defensive-player symbols during simulation of a "pass";

(iv) means for detecting the coincidence of said ball-position symbol with the offensive play symbol simulating a pass "receiver", thereby detecting a simulated pass completion, and for providing an indication of said simulated pass completion;

(v) means for detecting the independent coincidence of a defensive-player symbol with said "receiver" symbol to preclude movement of said "receiver" symbol to a position occupied by a defensive-player symbol; and (vi) means for monitoring play action to record information concerning the status of said simulated game and for producing signals indicative of said status information, said signals conveying the recorded information to the operator of the game; and d. a control board on said housing including a multiplicity of manually operable control elements, said control board being connected to said operational-circuit means for transmission of signals to said operational-circuit means through operation of said control elements, at least one of said manually operable control elements transmitting signals to said operational-circuit means which includes means operating upon said offensive play symbol movement means to effect movement of the offensive play symbol representing an intended "receiver", said operational-circuit means also including means operating upon said offensive play symbol movement means to effect advance of said ball-position symbol along a linear path upon actuation of a manually operable control element to simulate a "pass", said operational-circuit means including means for detecting coincidence of a defensive-player symbol with said ball position symbol prior to actuation of said ball-position symbol advancing means and terminating play action, said operational-circuit means including means for detecting coincidence of the advancing ball-position symbol and the "receiver" symbol to represent a "completed pass", said operational-circuit means including means for detecting coincidence of the advancing ball-position symbol and said selected at least one of said defensive-player symbols to represent an "intercepted pass", whereby the game operator may attempt to effect movement of said "receiver" symbol through said defensive-player symbols and to "pass" the ball-position symbol from its initial position to the "receiver" symbol along a linear path without coincidence of said ball-position symbol and any one of said selected multiplicity of defensive-player symbols along said linear path to said receiver.

32. The apparatus combination of claim 31 wherein said operational-circuit means transmits signals to said display panel to produce a ball-position symbol which differs in appearance from that of the rest of said offensive play symbols, advance of said ball position symbol to the "receiver" symbol to simulate a pass completion being indicated by replacement of said coincident "receiver" symbol with said ball-position symbol.

33. The apparatus combination of claim 32 wherein the appearance of said ball-position symbol during its advance in "pass" simulation differs from its appearance at other times, said ball-position symbol thereby simulating a ball during its advance in "pass" simulation and a ball carrier at other times.

34. The apparatus combination of claim 31 wherein said defensive movement means moves some of said defensive-player symbols in a variable manner towards said "receiver" symbol and others of said defensive-player symbols towards said ball-position symbol.

35. The apparatus combination of claim 31 wherein said control board includes a skill level control element for selecting the number of defensive-player symbols and said operational-circuit means generates and transmits signals to said display panel to produce a number of defensive-player symbols at the beginning of play action that depends on signals from said skill level control element.

36. The apparatus combination of claim 31 wherein said coincidence-detection means maintains separation between said defensive-player symbols and said "receiver" symbol during movement of said "receiver" symbol prior to advance of the ball-position symbol in "pass" simulation, said defensive-player and receiver symbols thereby being prevented from passing through each other, said coincidence-detection means detecting coincidence of a defensive-player symbol and the ball-position symbol upon "completion" of a "pass".

37. The apparatus combination of claim 31 wherein said coincidence-detection means suppresses, upon coincidence between a defensive-player symbol and an offensive play symbol other than said ball-position and "receiver" symbols, display of said coincident defensive-player and offensive play symbols until termination of play action.

38. The apparatus combination of claim 31 wherein said defensive-movement means moves at least a plurality of said defensive-player symbols in a variable manner towards said "receiver"symbol.

39. The apparatus combination of claim 31 wherein said control board includes a skill level control element for selecting the speed of movement of defensive-player symbols and said operational-circuit means generates and transmits signals to said defensive-movement means to move said defensive-player symbols at a rate that depends on signals transmitted from said skill level control element.

40. The apparatus combination of claim 31 wherein said offensive-movement means is arranged to produce manually-controlled movement of said "receiver" symbol after "completion" of a simulated "pass", manual control over the simulated pass "receiver" thereby being afforded.

41. The apparatus combination of claim 31 wherein said coincidence-detection means maintains separation between said defensive-player symbols and said "receiver" symbol during movement of said "receiver" symbol prior to advance of the ball-position symbol in "pass" simulation, said defensive-player and receiver symbols thereby being prevented from passing through each other, said coincidence-detection means detecting coincidence of a defensive-player symbol and the ball-position symbol upon "completion" of a "pass".

42. The apparatus combination of claim 31 wherein said defensive-movement means moves at least a plurality of said defensive-player symbols in a variable manner towards said "receiver" symbol.

43. The apparatus combination of claim 31 wherein said detection means includes means for detecting the independent coincidence of a defensive-player symbol with an offensive play symbol other than said ball-position symbol to limit movement of said coincident defensive-player symbol towards said ball-position symbol to simulate "blocking" of the defensive player symbol.

44. In a method for playing a simulated sports-action team game, the steps of:

a. providing a hand-holdable housing having a display panel including a simulated playing field of the type on which a ball-type game is played and adapted to display symbols in response to electrical signals applied thereto;

b. generating and transmitting electrical signals to said display panel to produce on said simulated playing field a multiplicity of offensive play symbols, one of said offensive play symbols at a time simulating the position of the ball, and to move about said playing field a multiplicity of said offensive play symbols including a "receiver" symbol and said ball-position symbol, said ball-position symbol being advanced in a linear path along said simulated playing field towards said "receiver" symbol to simulate a ball being "passed", said "pass" simulation to said "receiver" being at least in part under the manual control of the game operator;

c. generating and transmitting electrical signals to said display panel to produce on said simulated playing field a multiplicity of defensive-player symbols and to move a plurality of said defensive-player symbols along said playing field in a variable manner towards the ball-position symbol and a plurality of defensive-player symbols towards the "receiver" symbol, movement of said offensive play symbols and said defensive-player symbols simulating the action of said sports-action game;

d. detecting the independent coincidence of a multiplicity of offensive play symbols with a multiplicity of defensive-player symbols, and terminating play action upon detection of coincidence of said ball-position symbol with any one of a selected multiplicity of defensive-player symbols but permitting continuation of play action upon coincidence with a defensive-player symbol of an offensive play symbol other than said ball-position symbol;

e. moving said "receiver" symbol through the defensive-player symbols;

f. aligning said "receiver" symbol and ball-position symbol and thereafter advancing the ball-position symbol along a linear path towards the "receiver" symbol;

g. detecting the coincidence of said ball-position symbol with said "receiver" symbol to detect a simulated "pass completion" and providing an indication of said simulated "completion", and detecting coincidence of said advancing ball-position symbol with at least a selected one of said defensive-player symbols to detect a simulated intercepted "pass" and providing an indication of said simulation "interception";

h. monitoring play action to record information concerning the status of said simulated game; and i. generating signals indicative of said status information, said signals conveying the recorded information to the operator of the game.

45. The method of claim 44 wherein the step of detecting coincidence between said ball-position symbol and said selected at least one of said defensive-player symbols includes indicating a simulated pass "interception" when there is detected coincidence between said selected at least one of said defensive-player symbols and the advancing ball-position symbol during "pass simulation".

46. The method of claim 44 wherein said step of moving said offensive player symbols includes continuing motion of at least one of said offensive play symbols by manipulation of said manual control means after detection of a simulated pass "completion", said one offensive play symbol being the symbol resulting from coincidence of said advancing ball-position symbol and said "receiver" symbol.

47. The method of claim 44 wherein said ball-position symbol is distinct in appearance from the rest of said offensive play symbols; and further including the step of replacing the "receiver" symbol with a ball-position symbol upon detection of coincidence, thereby indicating the occurrence of a simulated completed pass.

48. The method of claim 47 wherein said step of moving said offensive play symbols includes the continuing motion of said ball-position symbol after replacement of said "receiver" symbol by said ball-position symbol.

49. The method of claim 44 wherein there is included the step of limiting the movement of at least some of said coincident defensive-player symbols coincident with an offensive play symbol other that said ball-position symbol to simulate "blocking" of the defensive-player symbols.

50. The method of claim 49 wherein the step of limiting movement of said "blocked" defensive-player symbols comprises suppressing the display of the coincident offensive play and defensive-player symbols.

51. The method of claim 44 additionally including the step of selecting a skill level for the play action of said game, said skill level selection controlling the number of defensive-player symbols generated on said simulated playing field.

52. The method of claim 44 wherein some of said defensive-player symbols are moved in a variable manner towards said "receiver" symbol and others of said defensive-player symbols are moved towards said ball-position symbol.

53. The method of claim 44 additionally including the step of selecting a skill level which controls the speed of movement of at least some of said defensive-player symbols.

54. In a method for playying a simulated sports action team game, the combination comprising:

a. providing a hand-holdable housing having a display panel including simulated playing field of the type in which a ball-type game is played and adapted to display symbols in response to electrical signals applied thereto;

b. generating and transmitting electrical signals to said display panel to produce on said simulated playing field a multiplicity of offensive play symbols, one of said offensive play symbols at a time simulating the position of the ball, and to move concurrently a multiplicity of said offensive play symbols including said ball-position symbol and at least one other offensive play symbol simulating a "blocker", said movement being in a controlled manner in a generally common direction along said playing field, movement of at least said ball-position symbol being under the manual control of the game operator;

c. generating and transmitting electrical signals to said display panel to produce on said simulated playing field a multiplicity of defensive-player symbols and to move concurrently a plurality of said defensive-player symbols along said playing field in a variable manner towards the ball position-symbol;

d. detecting the independent coincidence of a multiplicity of offensive play symbols with a multiplicity of defensive-player symbols and terminating play action upon detection of a coincidence of said ball-position symbol with a defensive-player symbol, said detection permitting continuation of play action upon coincidence between a defensive-player symbol and an offensive play symbol other than said ball-position symbol and prohibiting the movement of said defensive-player symbol coincident with said other offensive play symbols towards said ball-position symbol to simulate "blocking" of said last-mentioned defensive-player symbol;

e. monitoring play action to record information concerning the status of said simulated game; and f. generating signals indicative of said status information, said signals conveying the recorded information to the operator of the game.

55. The method of claim 19 wherein the step of prohibiting movement of said "blocked" defensive-player symbols comprises suppressing the display of the coincident offensive play symbol and defensive-player symbols.

56. The method of claim 54 additionally including the step of selecting a skill level for the play action of said game, said skill level selection controlling the number of defensive-player symbols generated on said simulated playing field.

57. Thhe method of claim 54 additionally including the step of selecting a skill level which controls the speed of movement of at least some of said defensive-player symbols.

* * * * *

UNITED STATES PATENT AND TRADEMARK OFFICE

CERTIFICATE OF CORRECTION

PATENT NO. : 4,249,735

DATED : February 10, 1981

INVENTOR(S) : Eric Bromley

It is certified that error appears in the above-identified patent and that said Letters Patent are hereby corrected as shown below:

Abstract, line 1, before "hand-" insert -- a --

Column 1, line 24, "symbols" should be -- symbol --

Column 6, line 44, "According" should be -- Accordingly --

Column 11, line 45, "moves" should be -- move --

Column 14, line 7, "micrprocessor" should be -- microprocessor --; line 19, "02 and 01" should be -- 02 and 01 --; lines 23 and 31, "01" should be -- 01--

Column 19, line 25, "the-ball position" should be -- the ball-position --; line 31, Claim 17 should be dependent upon Claim 16, not Claim 6; line 34, after "-player" insert -- symbols --; line 42, Claim 18 should be dependent upon Claim 17, not Claim 7

Column 25, line 59, "other that" should be -- other than --

UNITED STATES PATENT AND TRADEMARK OFFICE

CERTIFICATE OF CORRECTION

PATENT NO. : 4,249,735

DATED : February 10, 1981

INVENTOR(S) : Eric Bromley

It is certified that error appears in the above-identified patent and that said Letters Patent are hereby corrected as shown below:

Column 26, line 12, "playying" should be -- playing --; line 54, Claim 55 should be dependent upon Claim 54, not Claim 19; line 64, "Thhe" should be -- The --

Signed and Sealed this

*Twenty-seventh* Day of *December 1983*

[SEAL]

*Attest:*

GERALD J. MOSSINGHOFF

*Attesting Officer*

*Commissioner of Patents and Trademarks*